United States Patent [19]

Seymour et al.

[11] 4,408,174

[45] Oct. 4, 1983

[54] ACCESSORY MOUNTING MODULE FOR J AND K FRAME BREAKERS

[75] Inventors: Raymond K. Seymour; Dennis J. Doughty, both of Plainville, Conn.

[73] Assignee: General Electric Co., New York, N.Y.

[21] Appl. No.: 330,109

[22] Filed: Dec. 14, 1981

[51] Int. Cl.[3] ..... H01H 83/00

[52] U.S. Cl. ..... 335/20; 335/155

[58] Field of Search ..... 335/20, 155

[56] References Cited

U.S. PATENT DOCUMENTS 3,919,674 11/1975 Acampora et al. ..... 335/20

4,075,584 2/1978 Castonguay et al. ..... 335/20

4,097,831 6/1978 Jencks et al. ..... 335/20

*Primary Examiner*—Harold Broome

*Attorney, Agent, or Firm*—Richard A. Menelly; Walter C. Bernkopf; Fred Jacob

[57] ABSTRACT

A multi-functional mounting module for J and K frame breakers utilizes an accessory post for mounting a plurality of breaker accessories for common actuation by means of a resettable tripping mechanism cooperating with the breaker trip assembly. A slidably mounted cam assembly on the module housing provides for tripping the breaker under predetermined conditions as well as resetting and indicating the breaker operational state.

19 Claims, 9 Drawing Figures

ACCESSORY MOUNTING MODULE FOR J AND K FRAME BREAKERS

BACKGROUND OF THE INVENTION

Breaker accessories are currently available for molded case circuit breakers which allow a plurality of auxiliary functions to be inserted within the breaker assembly without substantial modification to the assembly. U.S. patent application Ser. No. 088,714, filed Oct. 26, 1979, and assigned to the assignee of the instant invention describes one such standardized breaker accessory package.

Breaker accessory functions are described within the following U.S. Pat. Nos.: 4,166,260; 4,097,831; 4,075,584; 3,162,740; 3,360,751; and 3,919,674.

When accessories such as described within the above patents are employed within J and K frame breakers, each of the individual accessories must be particularly tailored to fit the breaker housing. With the advent of MICRO-VERSATRIP ® molded case circuit breakers as described within the General Electric Product Bulletin GEA10676 contained within a compact breaker housing, a need was developed for a compact accessory module which could be readily fitted within the breaker housing with little or no modification to the housing.

The purpose of this invention is to describe a mounting module which is adapted to receive a plurality of breaker accessories and which can be inserted within various J and K frame breakers without modification to the breaker enclosure. The module also carries an electrically insulative protective cover to display the particular accessory circuit diagrams in accordance with UL requirements.

SUMMARY OF THE INVENTION

A mounting module for accessories to be used within insulated case circuit breakers employs a metal platform having insulating mounting means at one end and an insulative wire support at an opposite end. An accessory mounting post proximate a slidably mounted trip assembly allows a variety of accessories to be employed for tripping the breaker contacts as well as indicating the electrical status of the breaker such as an undervoltage condition or the position of the main circuit breaker contacts. A resetting actuator arm automatically loads the tripping assembly spring upon contact with the breaker tripping arm. Electrical signals to a solenoid mounted in operative proximity to the slide assembly causes the breaker to trip upon command.

DESCRIPTION OF THE PREFERRED EMBODIMENT

Figure 1:
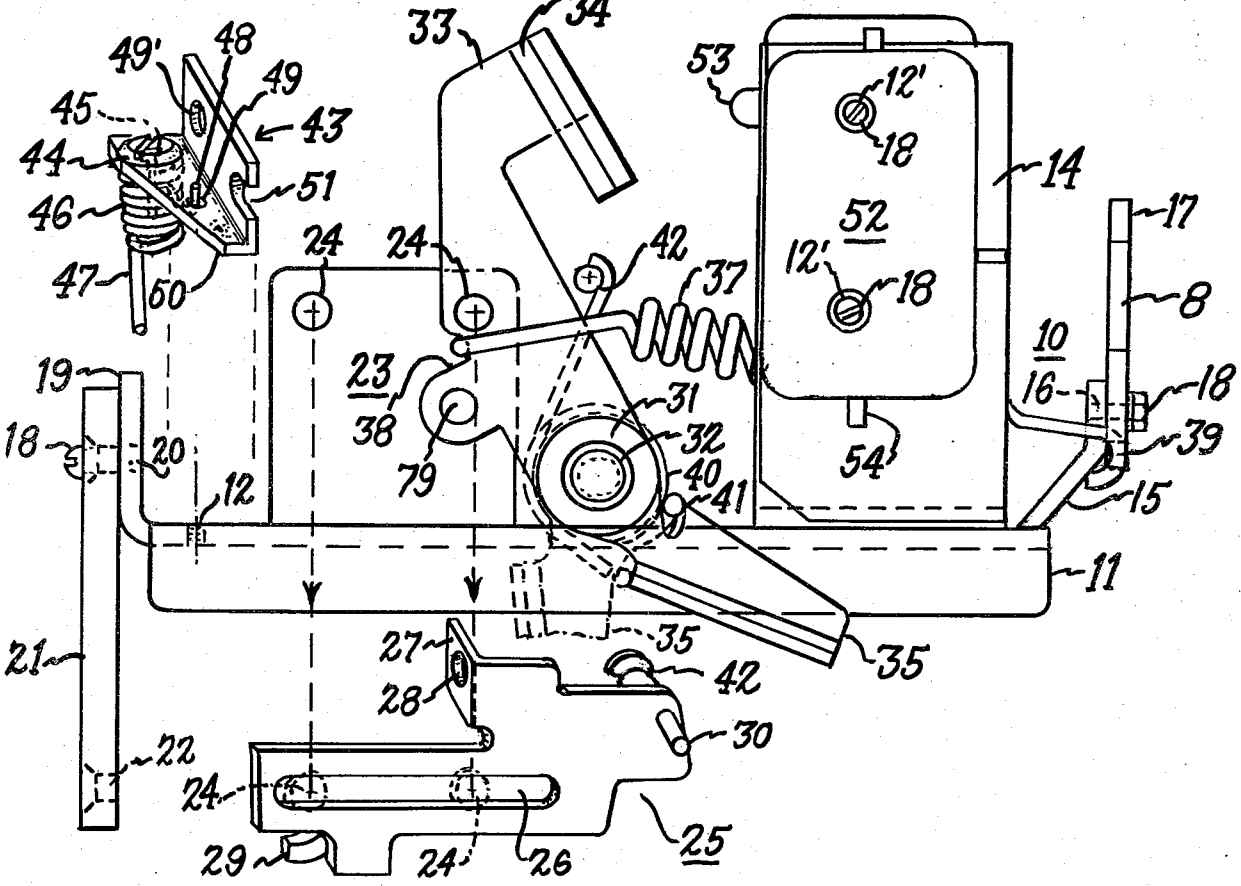
FIG. 1 contains a side view of the mounting module according to the invention with the tripping mechanism portrayed in isometric projection.

FIG. 1 shows a mounting module 10 consisting of a platform 11 made from a metal stamping and containing a mounting slot 12 at one end and a pair of accessory mounting posts 14. Also attached to platform 11 is an extension 15 at an opposite end from mounting slot 12 for attaching wire support 17 by means of a slot 16 and screw 18. A plurality of parallel extending slots 8 are provided within wire support 17 for retaining the wires used to connect the accessory mounted on accessory post 14 and to prevent the inadvertent disconnection of such wires when the power supply cord is subjected to excess force. A plurality of mounting slots 12' are arranged through accessory post 14 to receive the screws used to attach the various auxiliary devices, such as switch 52, required within the breaker assembly. At an opposite end from wire support 17 a front platform extension 19 is provided having a slot 20 which extends through platform extension 19 and through an insulated plate 21 for attaching plate 21 to mounting module 10. Slot 22, provided at a bottom portion of insulated plate 21, is used for receiving a mounting pin extending from within the breaker assembly. A cam supporting bracket 23 is fixedly attached to platform 11 for housing a pair of aligned cams 24. A cam slide assembly 25 containing an elongated cam slot 26, tripping arm 27 and mounting slot 28 is slidably supported on bracket 23 by means of cams 24. Mounting slot 28 is connected with the tripping mechanism of the breaker within which mounting module 10 is employed. A detent 29 is formed on the lower surface of cam slide assembly 25 for a purpose to be described below in greater detail. A pin 30 and an extension 42 are fixedly attached to cam slide assembly 25 for contacting a portion of reset lever 33 connected to platform 11 by means of a pivot support bracket 31 and pivot 32. Lever arm 34, attached to one end of reset lever 33, moves into contact with a portion of accessory post 14 when actuator arm 35 is inserted within the breaker assembly. Insulated plate 36 on actuator arm 35 prevents electrical contact between platform 11 and the electrified breaker when actuator arm 35 is in contact with the breaker assembly. Reset spring 37, held at one end by groove 38 on actuator arm 35 and at the other end by groove 39 on a portion of accessory post 14, provides the necessary force to hold lever arm 34 in contact with a portion of accessory post 14 when actuator arm 35 is in the position indicated in dotted lines. Trip spring 40, attached at one end to shoulder 41 on lever 33 and at the other end to extension 42 on cam mechanism 25, provides sufficient driving force to cam slide assembly 25 to move tripping arm 27 into contact with the breaker tripping arm (not shown) and to cause the breaker to trip when the breaker tripping arm is in contact with tripping arm 27 by means of mounting slot 28.

Figure 2:
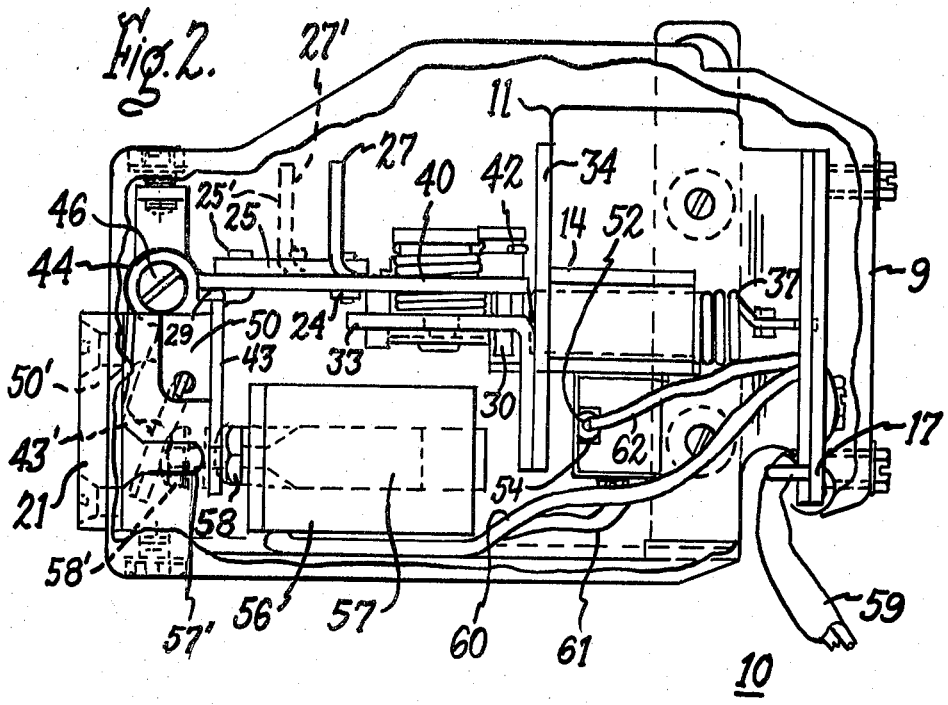
FIG. 2 is a top view of the mounting module depicted in FIG. 1 with a shunt trip accessory attached.

A solenoid actuated arm 43 is mounted on platform 11 by means of the arrangement of a collar 44 and screw 45. Latch spring 46 is attached to a portion of platform extension 19 at spring end 47 and to latch extension 50 at spring end 48 by connecting spring end 48 through hole 49. The arrangement of spring 46 provides for the pivotal movement of extension 50 on solenoid actuator arm 43 to prevent cam slide 25 from coming into contact with the circuit breaker trip arm (not shown). This is accomplished by the engagement between extension 50 on solenoid actuated arm 43 and detent 29 on cam slide assembly 25. Slot 51 at the end of solenoid actuated arm 43 operatively engages solenoid 56 by means of plunger 57 and plate 58 as shown in FIG. 2. Also shown in FIG. 2 is the operative arrangement between extension 42 and pin 30 extending through reset lever 33. Collar 44 is shown attached to platform 11 to hold spring 46 in operative relationship with solenoid actuated arm 43. Reset spring 37 is shown extending between accessory posts 14 to provide sufficient force to actuator arm 35 in order to bring lever arm 34 into contact with switch 52 mounted on platform 11. A cover 9 for the purpose of preventing inadvertent contact with wires 60, 61 extending from power cable 59 through wire support 17 completely encloses module 10 and will be described below in greater detail.

Solenoid 56 and switch 52, having actuating button 53 in operative relation to lever arm 34 and electrical contact lugs 54 as shown in FIGS. 1 and 2, are employed within module 10 when used as a shunt trip accessory. A control signal applied to solenoid 56 by means of wires 60, 61 causes plate 58 of plunger 57 to extend to the position shown in dashed lines where latch extension 50', at the end of solenoid actuated arm 43', releases detent 29 on cam slide assembly 25' which engages the breaker trip arm (not shown) to trip the breaker. Switch 52 is electrically connected in series with solenoid 56 by means of lug 54 and wire 62 in order to de-energize solenoid 56 when reset lever 33 returns to the position shown after circuit breaker tripping. The de-energization of solenoid 56 is required to prevent solenoid 56 from becoming damaged by excessive current.

Figure 3:
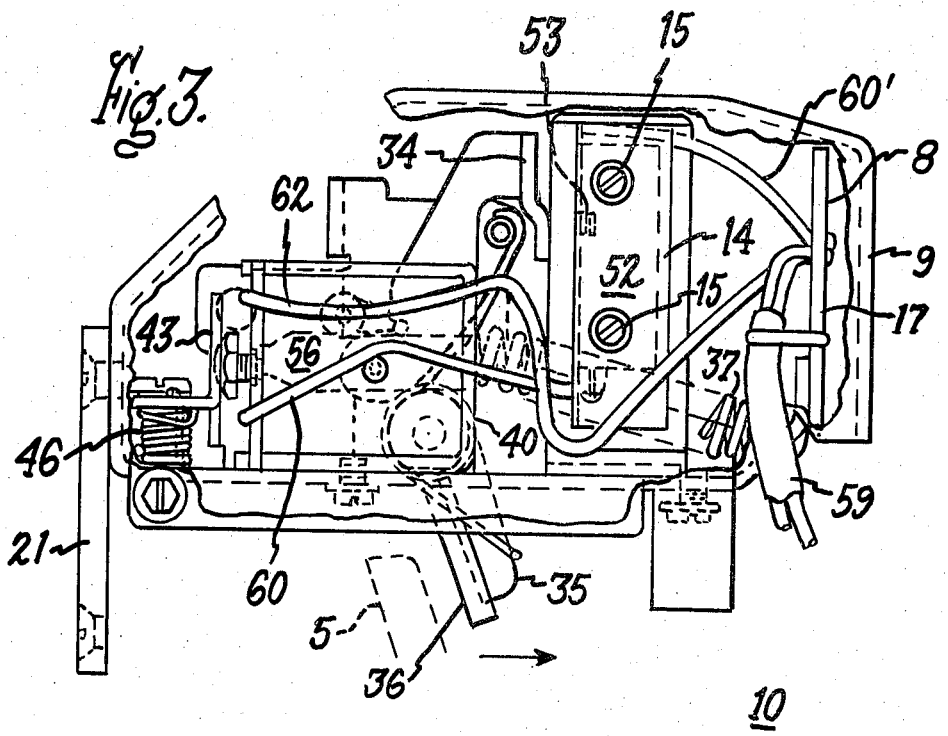
FIG. 3 is a side view of the mounting module depicted in FIG. 2.

Actuator arm 35, shown in FIG. 3, moves in the direction shown by the indicating arrow when the associated circuit breaker (not shown) is manually reset and turned on. Plunger 57 assumes the position indicated in dashed lines at 57' in FIG. 2 if solenoid 56 remains remains energized, preventing latch extension 50 from being retained by detent 29 on cam slide assembly 25' so that tripping arm 27 extends to the position shown in dashed lines at 27'. An electric signal on solenoid 56 therefore prevents the breaker from being reset and turned on after tripping. Lever arm 34 releases switch 52 in order to provide electrical continuity from power cable 59 through wires 60, 61 and 62 for providing shunt trip function to solenoid 56. If, however, no signal is present on solenoid 56 when attempt is made to manually reset the breaker, plunger 57 remains within solenoid 56 so that detent 29 and cam slide assembly 25 assume the positions indicated in solid lines holding tripping arm 27 in its non-tripping position against the force exerted by tripping spring 40.

Also shown in FIG. 3 is the functional relationship between actuator arm 35 containing insulated plate 36 and trip spring 40. Upon insertion of module 10 within a breaker assembly, insulated plate 36 on actuator arm 35 contacts a portion of the breaker contact arm 5 shown in phantom configuration when the breaker is turned on. The wiring arrangement shown in FIG. 2 is shown herein in greater detail. Power cable 59 containing wires 60 and 62, for example, which pass through a slot 8 in wire support 17, are electrically connected to solenoid 56 and electrically connected in series through switch 52 by means of wire 60' which connects from power cable 59 to one side of switch 52 for purposes which will be described below in greater detail. Switch 52 is attached to mounting posts 14 by means of screws 15 in order to hold switch 52 fixedly in place when contact is desired between operating button 53 on switch 52 and lever arm 34. A plurality of accessory devices, such as described in the aforementioned U.S. patents, can be mechanically and electrically connected within module 10 depending upon the desired function. Common reference numerals will be used throughout this disclosure in order to refer to like elements used within common module 10.

Figure 4:
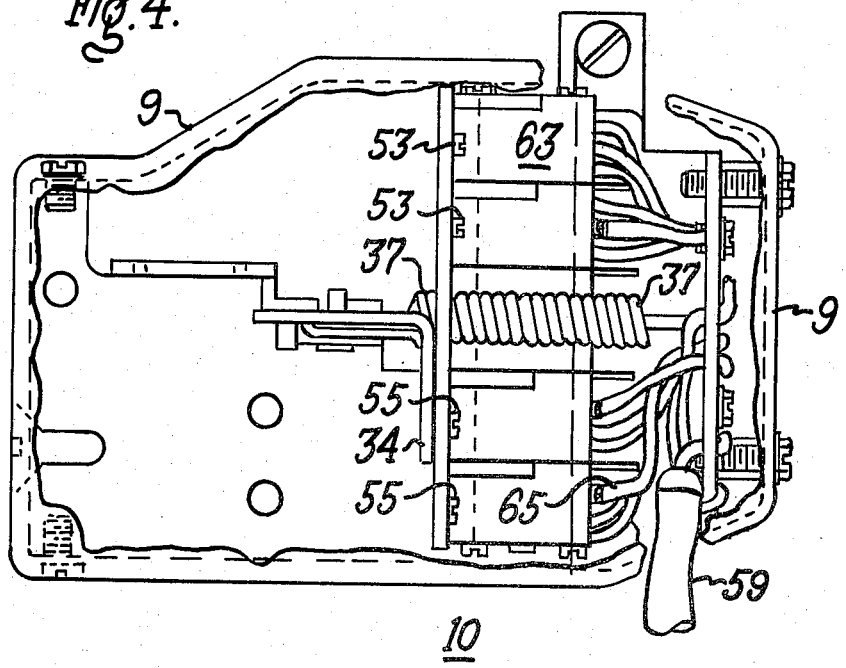
FIG. 4 is a top view of the mounting module shown in FIG. 1 with a plurality of auxiliary switches attached.
Figure 5:
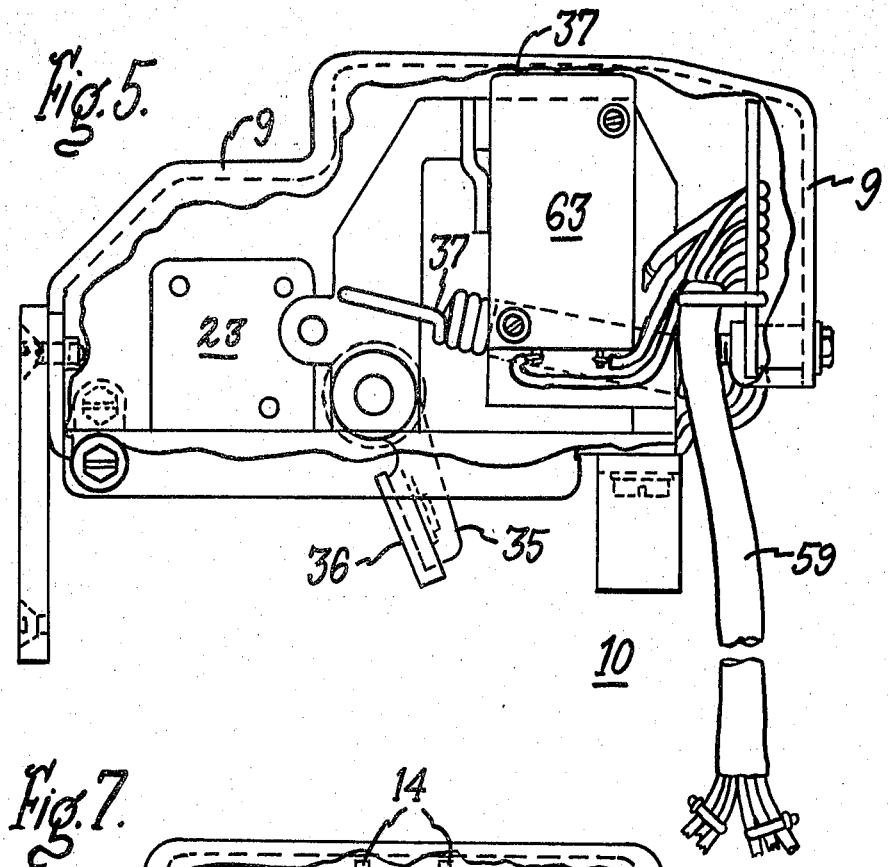
FIG. 5 is a side view of the mounting module depicted in FIG. 4.
Figure 6:
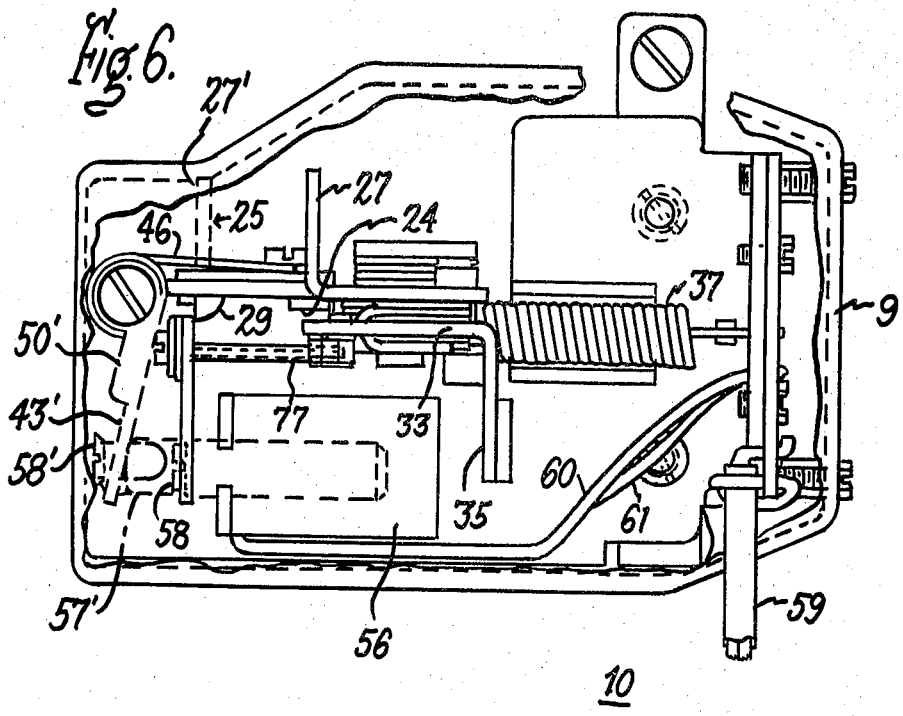
FIG. 6 is a top view of the mounting module of FIG. 1 with an undervoltage accessory attached.

FIG. 4 shows module 10 containing a plurality of auxiliary switches 63 for providing a plurality of functions upon movement of lever arm 34 in and out of contact with a corresponding plurality of actuating buttons 53. Module 10 is similar to that depicted in FIGS. 1–3 wherein reset spring 37, in cooperation with actuator arm 35, causes switches 63 to be in one state of operation when the associated circuit breaker contacts (not shown) are closed and in a different state when the circuit breaker contacts are caused to become open. Auxiliary switches 63 can be employed to operate indicating lamps, alarms or to activate relays for recording purposes. FIG. 5 shows the functional relationship between actuator arm 35, insulator plate 36 and reset spring 37 relative to auxiliary switches 63 when the circuit breaker contacts are open and when no current is flowing through the breaker contacts. As discussed earlier, insertion of module 10 within the breaker compartment is such that the contact arm 5 connected with the breaker assembly contacts insulating plate 36 moving it into the direction indicated in FIG. 3 when the breaker is turned on. Other functions can be provided to module 10 depending upon whether solenoid plunger 57 (not shown) is normally extended or retracted. Solenoid plunger 57 is normally retracted with no power applied to solenoid 56 and becomes extended when solenoid 56 becomes energized, as described earlier, for the shunt trip function. When employed as an undervoltage function, as shown in FIG. 6, solenoid plunger 57 is normally extended and becomes retracted when energized. The amount of voltage required to maintain plunger 57 in solenoid 56 in such a condition can be equivalent to the necessary voltage level required to operate an electric motor (not shown). Upon the occurrence of an undervoltage condition wherein the voltage supplied to the electric motor and to solenoid 56 by means of lead wires 60, 61, would be insufficient to operate the electric motor and to maintain solenoid plunger 57 in its retracted condition against the spring tension of latch spring 46, plunger 57 immediately extends to the position shown at 43' in dashed lines causing plate 58 to extend to 58' bringing latch extension 50 to 50' thereby allowing detent 29 in cam slide assembly 25 to move along cams 24 allowing tripping arm 27 to move to the position indicated in dashed lines to 27' to contact the breaker trip arm and trip the breaker. As described earlier, the associated breaker becomes reset by means of reset spring 37. Solenoid arm 43' is returned to position 43 by means of the connection between reset screw 77 pivotally attached to reset lever 33 by means of pin 78 extending through slot 79, shown more clearly in FIG. 1. Upon receiving sufficient voltage on wires 60, 61 to operate the aforementioned motor at rated voltage and to cause solenoid 56 to become energized, plunger 56 is magnetically retracted and retained in solenoid 56 such that plate 58 retains solenoid actuated arm 43 and latch extension 50 to that shown in solid lines at 50 and 43. When the associated circuit breaker is reset manually and turned on, solenoid 56 is again in condition for becoming de-energized when undervoltage is supplied to the associated electric motor.

A further accessory application for mounting module 10 containing solenoid 56 as shown in FIGS. 2, 3 and 6 can be for a blown fuse trip function. Actuator arm 35 is in the position shown in FIGS. 2 and 3 such as in contact with an untripped circuit breaker trip arm and with electric power supplied to solenoid 56 by means of wires 60, 61, plunger 57, with plate 58 and extension 50 is in the position shown in FIG. 2 with tripping arm 27 in its non-trip position. Each of three independent windings (not shown) within solenoid 56 can be connected across power fuses used in the circuit breaker power system (not shown). If one or more fuses blow, line potential becomes applied across the corresponding coil winding causing solenoid 56 to be energized. Plunger 57 then extends, causing plate 58 to extend solenoid actuated arm 50 to 50', which releases tripping arm 27. The circuit breaker becomes tripped by the movement of cam slide mechanism 25 and tripping arm 27 in the manner described earlier. The tripping of the associated circuit breaker removes line potential from the coil windings within stenoid 56. Replacement of the blown fuse results in the deenergization of solenoid 56 and the outward movement of plunger 57 causing plate 58 to move latch extension 50 to that indicated in solid lines. Resetting and turning on the breaker causes actuator arm 35 to move in the direction indicated in FIG. 3 and cam slide mechanism 25 to move in the manner described earlier.

The multi-functional aspects of mounting module 10 shown in FIGS. 1–6 above wherein a solenoid such as 56 shown in FIG. 2, for example, and auxiliary switches 63 as shown in FIG. 4 or switch 52 shown in FIG. 2 can be employed for the wide variety of auxiliary functions as described in the aforementioned U.S. patents. The electrical interrelationship between one or more solenoids 56 and switches 63 can provide shunt trip, undervoltage release, blown fuse release, as well as visible and audible indication of which function has occurred by appropriate electrical connection through switches 63.

Figure 7:
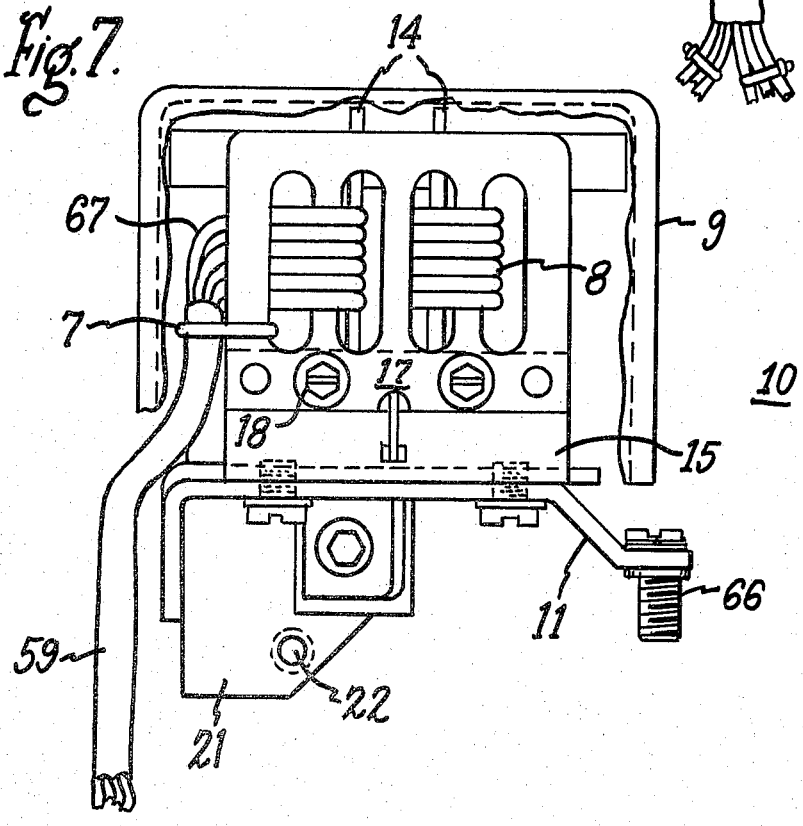
FIG. 7 is a rear view of the mounting module depicted in FIG. 1 showing the wire support arrangement.
Figure 9:
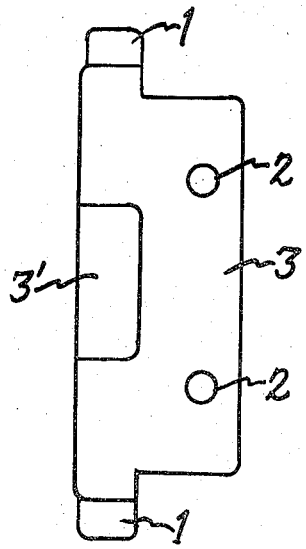
FIG. 9 is a top view of a mounting foot used with the module of the invention.

Besides providing mounting facility to solenoid 56, auxiliary switches 63 and switch 52, mounting module 10 further provides for the retention of a plurality of wires generally described as 67 as shown in FIG. 7. As described earlier, wire support 17 is connected with extension 15 by means of screws 18. Cable 59 brings wires 67 up to support 17 and can be connected to support 17 by means of staple 7 to prevent inadvertent movement of cable 59 when wires 67 are intertwined within rectangular slots 8 formed within support 17 which can be manufactured from an insulating material such as a fiberglass-enforced plastic resin. A mounting screw 66 attached to platform 11 provides means for removably connecting mounting module 10 within a portion of the breaker assembly. Module 10 is positioned within the breaker assembly by insertion of a prong within the circuit breaker assembly to within slot 22 shown earlier in FIG. 1. In some breaker assemblies, platform 11 can be removed and be replaced by mounting foot 4, shown in FIG. 9, having a base portion 3 with openings 2 to provide access for mounting screws and a pair of ears 1 to insert within notches in the breaker assembly. Opening 3' defines a space sufficient to allow clearance for the breaker contact arm. The provision of wire support 17 allows wires 67 to sustain separation forces in excess of those required for UL approval.

Figure 8:
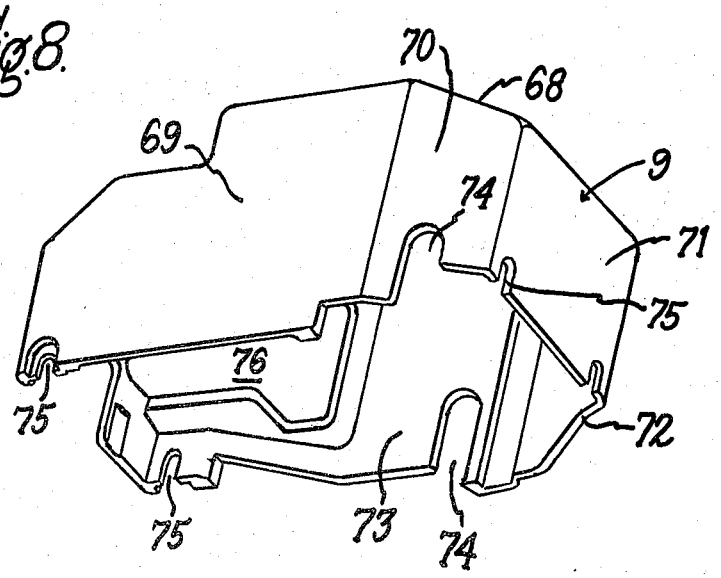
FIG. 8 is a side perspective view of an insulative cover for use with the mounting module according to the invention.

To further comply with UL approval, cover 9, shown in greater detail in FIG. 8, is manufactured from an insulating plastic material by mold forming techniques. Cover 9 contains a top 68, sides 69, 70, 71, 72 and 73. A plurality of screw access holes 75 and wire access holes 74 are integrally provided within cover 9 for attaching cover 9 to an associated plurality of holes which can be provided within platform 11 in FIG. 1. Also formed within cover 9 during the molding process is a breaker arm access opening 76 whereby an extension of the breaker tripping mechanism can be attached to tripping arm 27. Access between actuator arm 35, which extends from the bottom of platform 11, as shown in FIG. 3, and the breaker contact arm described earlier, is made from the bottom portion of cover 9 which is completely open. In further compliance with UL requirements, circuit information such as the electrical wiring diagrams required for the various auxiliary functions can be printed on top portion 68 to provide circuit wiring information without the requirement of removing cover 9.

We claim:

1. An accessory mounting module for circuit breakers comprising:

a base having a pair of upright posts for carrying an electrical accessory device and including means at one end for receiving a locating pin on a circuit breaker and means at an opposite end for fastening said base to said circuit breaker;

a reset lever pivotally and vertically mounted on said base having a lever arm at one end for actuating said accessory device and an actuator arm at another end for contacting a circuit breaker tripping arm;

a trip assembly slidably mounted on a pair of cams extending from a bracket attached to said base and attached to a trip mechanism on said circuit breaker; and latch means on said base carrying a detent for engaging with said trip assembly to hold said trip assembly against a trip spring force until said latch means is pivoted by operation of a solenoid to move said detent away from said trip assembly causing said trip assembly to move said circuit breaker trip mechanism to trip said breaker.

2. The mounting module of claim 1 wherein said reset lever includes a lever arm at one end for contacting a portion of said accessory and an actuator arm at another end for contacting a circuit breaker tripping arm.

3. The mounting module of claim 1 including a reset spring connecting between said reset lever and said actuator for opposing a force applied to said actuator arm when said mounting module is inserted within said circuit breaker and said circuit breaker is turned on.

4. The mounting module of claim 3 wherein said actuator arm carries an insulated plate for electrically insulating said mounting module from said circuit breaker.

5. The mounting module of claim 1 wherein said trip assembly includes an elongated slot for positioning said cam members and for enabling said trip assembly to move in a plane defined by the surface of said base member.

6. The mounting module of claim 5 including a tripping spring connecting with a portion of said actuator arm at one end and with a portion of said tripping assembly at another end for moving said cam assembly along said cam members.

7. The mounting module of claim 6 including a tripping arm extending from said trip assembly for connection with said circuit breaker trip mechanism to cause said circuit breaker to trip under the force exerted by said tripping spring.

8. The mounting module of claim 7 including a pin mounted on said trip assembly for contacting said actuator arm causing said reset spring to oppose said trip assembly.

9. The mounting module of claim 8 wherein said latch means includes a latching arm pivotally mounted on said base for contacting said slide assembly.

10. The mounting module of claim 9 wherein said trip assembly includes a detent, said detent catching a portion of said latching arm for retaining said trip assembly against the force of said trip spring.

11. The mounting module of claim 10 wherein said latch means includes contact means at one end of said latch arm for contact with a solenoid plunger whereby said plunger, in contact with said contact means, moves said latch arm out of contact with said detent, causing said trip assembly to move under the force of said trip spring.

12. The mounting module of claim 11 further including a latch spring for returning said latch arm into contact with said detent and out of contact with said solenoid plunger.

13. The mounting module of claim 3 wherein said reset spring is a tension spring.

14. The mounting module of claim 6 wherein said tripping spring is a torsion spring.

15. The mounting module of claim 12 wherein said latch spring is a torsion spring.

16. The mounting module of claim 1 further including an insulated cover on said base for preventing contact with said auxiliary device on said base.

17. The mounting module of claim 16 wherein said cover consists of a molded plastic housing having slots formed therein for providing access to electric wires and mounting screws.

18. The mounting module of claim 17 wherein said housing contains a top portion and a plurality of said portions and further defines an opening opposite said top portion for providing access between said reset lever, said trip assembly and said latch means.

19. The mounting module of claim 18 wherein said cover further includes means defining an opening for providing access to a portion of said circuit breaker tripping arm.

* * * * *